United States Patent [19]

Dixon

[11] 4,111,292

[45] Sep. 5, 1978

[54] COIN MACHINE SLUG REJECTOR

[76] Inventor: Eugene H. Dixon, 16022 SE. River Rd., Milwaukee, Wis. 97222

[21] Appl. No.: 771,655

[22] Filed: Feb. 24, 1977

Related U.S. Application Data

[63] Continuation of Ser. No. 534,631, Dec. 19, 1974, abandoned.

[51] Int. Cl.[2] ..... G07F 3/02

[52] U.S. Cl. ..... 194/101

[58] Field of Search ..... 194/97 R, 100 R, 101, 194/DIG. 16, DIG. 20, 1 E; 209/81 A, 118, 8

[56] References Cited

U.S. PATENT DOCUMENTS

| | | | |
|---|---|---|---|
| 2,040,166 | 5/1936 | Carter | 194/101 |
| 2,278,930 | 4/1942 | Hoyt | 194/101 |
| 2,298,440 | 10/1942 | Vieth | 194/101 |
| 2,698,074 | 12/1954 | Krysiak | 194/100 R |
| 2,891,112 | 6/1959 | Lamb et al. | 194/101 |

*Primary Examiner*—Allen N. Knowles
*Assistant Examiner*—H. Grant Skaggs
*Attorney, Agent, or Firm*—Oliver D. Olson

[57] ABSTRACT

A housing of non-magnetic material and provided with a coin slot therethrough also contains a rejector finger which is positioned normally adjacent the coin slot but which is movable by an associated magnet to intercept the coin slot when a magnetic coin or other magnetic slug, i.e., a coin or slug which includes a metal having magnetic susceptibility, is inserted in the coin slot.

6 Claims, 6 Drawing Figures

COIN MACHINE SLUG REJECTOR

This is a continuation of application Ser. No. 534,631, filed Dec. 19, 1974, now abandoned.

BACKGROND OF THE INVENTION

This invention relates to coin-operated machines, and more particularly to means by which magnetic coins and other similarly magnetic slugs are rejected from the machine.

Coin-operated machines heretofore have been provided either with no means for protection against the use of unauthorized coins or slugs, or with complex and costly apparatus by which all types of coins and slugs are accepted through a coin slot, whereupon the apparatus operates to select only those coins which have been predetermined to be authorized to operate the coin machine. This latter type of apparatus contributes to the excessive cost of the machine, is susceptible of malfunctioning and requires considerable maintenance.

SUMMARY OF THE INVENTION

In its basic concept, this invention provides means by which magnetic coins and other similarly magnetic slugs are prevented from entering an associated coin-operated machine.

It is by virtue of the foregoing basic concept that the principal objective of this invention is achieved; namely, to overcome the aforementioned limitations and disadvantages of prior coin-operated machines.

Another important object of this invention is the provision of a coin machine slug rejector which is adaptable for mounting upon existing coin-operated machines with maximum facility and minimum cost.

A further objective of this invention is the provision of a coin machine slug rejector which is of simplified construction for economical manufacture and which is capable of long and reliable operation with a minimum of maintenance.

The foregoing and other objects and advantages of this invention will appear from the following detailed description, taken in connection with the accompanying drawing of preferred embodiments.

DESCRIPTION OF THE PREFERRED EMBODIMENTS

Figure 1:
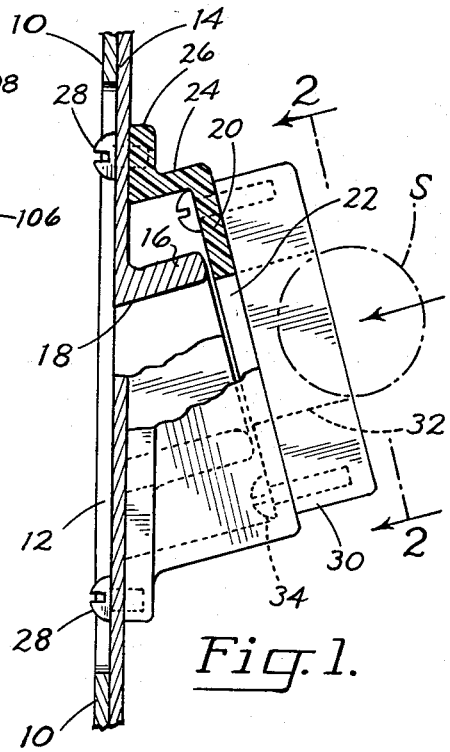
FIG. 1 is a fragmentary view in side elevation of a coin-operated machine illustrating the manner in which the coin inlet slot of the machine is associated with a slug rejector embodying the features of this invention, parts being broken away to disclose details of internal construction.

For purposes merely of illustration, FIG. 1 shows a portion of the front wall 10 of a coin-operated machine. Overlying an opening 12 in said front wall is an ornamental escutcheon plate 14 which includes an outwardly projecting boss 16 provided with a coin insert slot 18 extending therethrough. As is well known, the coin insert slot also registers with mechanism within the machine operated by a coin to effect activation of the machine.

In accordance with one embodiment of this invention, a slug rejector may be associated with the coin insert slot 18. As exemplified in FIG. 1, this is afforded by the provision of an adapter, preferably formed as a one-piece unit by the front plate 20 provided with an auxiliary coin slot 22 and bounded by a peripheral wall 24 which terminates in a peripheral flange 26. The adapter is designed dimensionally to overlie the boss 16 with the auxiliary coin slot 22 in the front wall registering with the coin insert slot 18 of the boss. The adapter may be secured to the escutcheon by any suitable means, such as by the screws 28 illustrated.

The front wall of the adapter supports a slug rejector which, in accordance with this invention, functions to prevent the insertion of a magnetic coin or other magnetic slug into the coin-operated machine. One such slug rejector is illustrated in FIGS. 1–4. It includes a housing 30 of non-magnetic material having a coin insert slot 32 extending therethrough. The housing is secured to the front wall 20 of the adapter, as by means of screws 34, so that the coin insert slot 32 registers with the auxiliary slot 22 in the wall.

Figure 4:
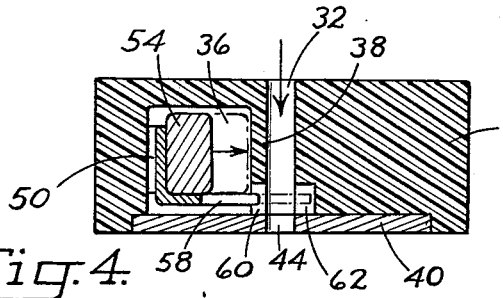
FIG. 4 is a transverse section taken on the line 4—4 in FIG. 3.

Adjacent the coin slot 32 the housing is formed with a chamber 36 (FIG. 4) which is separated from the coin slot by a thin wall portion 38 of the housing. The chamber is closed on the rearward side of the housing by means of a rear cover plate 40 which also is of non-magnetic material and which is secured removably in a recess in the housing by such means as screws 42. The cover plate also is provided with a transverse slot 44 which registers with the coin slot 32 in the housing (FIG. 4).

A slug rejector finger member is contained within the chamber 36 for movement between a position normally retracted from the coin slot 32 and a position intercepting the coin slot, whereby to prevent the passage of a magnetic coin or other magnetic slug 5 (FIG. 1) through the slot. In the embodiment illustrated in FIGS. 1–4, the finger member is in the form of a lever 50 of non-magnetic material. One end of the lever is supported pivotally within the chamber 36, as by reception of the lateral terminal extensions 52 (FIG. 3) of the lever in aligned bearing sockets in the housing 30 and cover plate 40.

The end portion of the lever 50 opposite the pivot 52 supports a permanent magnet 54 on the side thereof facing the coin slot 32. The magnet may be secured to the lever by any suitable means, such as adhesive, screws, etc. In the presently described embodiment, and best shown in FIGS. 2 and 3, the lower end portion of the lever is offset angularly to form a supporting base 56 for the magnet.

Secured to the lever 50 and extending laterally therefrom adjacent the end opposite the pivot 52, is a slug rejector finger 58. It extends beyond the magnet 54 and registers with a lateral opening 60 (FIG. 4) through the thin wall portion 38 of the housing. The finger thus is movable through the opening between said normally retracted position and the slot-intercepting position described hereinbefore. If desired, a portion of the housing 30 on the side of the coin slot 32 opposite the thin wall 38 and in alignment with the opening 60 in the latter may be removed to form a cavity 62 for the reception of the finger.

Means are provided for retaining the finger in the normally retracted position previously described. In the embodiment of FIGS. 1–4 and best shown in FIGS. 2 and 3, this means is provided by a coil spring 64 which is seated at one of its ends in a socket 66 formed in the housing chamber. The opposite end of the spring encircles, and thus is retained by, a projection 68 on the lever between the pivot 52 and the magnet 54. The spring thus normally urges the finger lever clockwise (FIG. 2) to the full line position illustrated in FIGS. 2 and 4.

Figure 2:
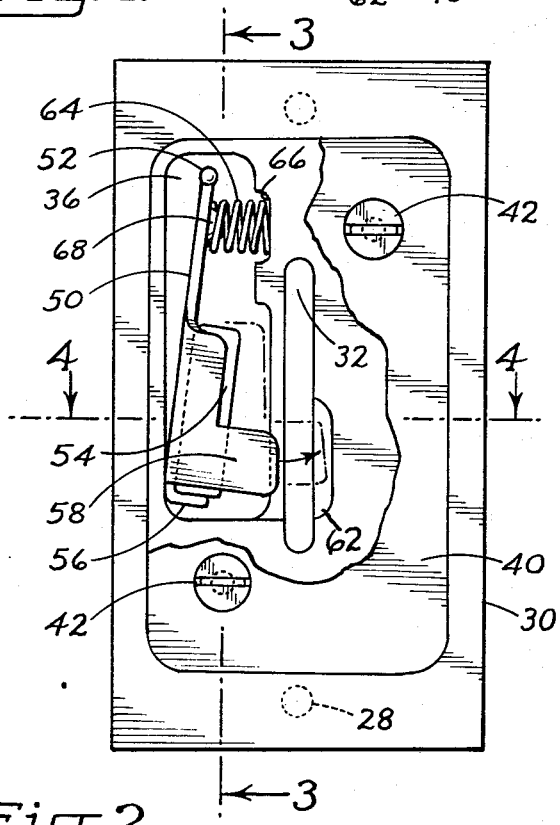
FIG. 2 is a view in front elevation, as viewed in the direction of arrows 2—2 in FIG. 1 of a coin machine slug rejector embodying the features of this invention, parts being broken away to disclose details of internal construction.
Figure 3:
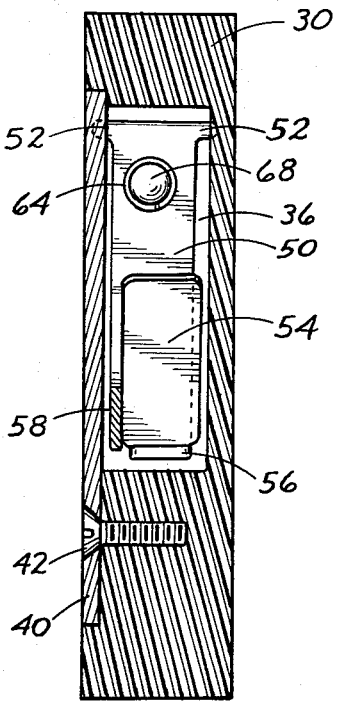
FIG. 3 is a longitudinal section taken on the line 3—3 in FIG. 2.

However, upon the attempt to insert a magnetic coin or other magnetic slug S through the coin slot 32, in the direction of the arrow illustrated in FIG. 4, the magnet 54 is attracted toward the coin slot, to the position illustrated in broken lines in FIGS. 2 and 4, thereby simultaneously extending the slug rejector finger 58 transversely through the coin slot. The finger thus forms a physical barrier by which the slug is positively rejected and thus is prevented from entering the coin-operated machine.

On the other hand, non-magnetic coins will pass freely through the coin slot since they will not attract the magnet.

Figure 5:
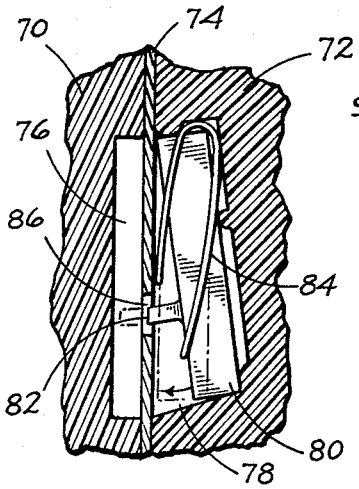
FIG. 5 is a fragmentary view in transverse section of a second embodiment of a coin machine slug rejector embodying features of this invention.

In the embodiment illustrated in FIG. 5, the housing is constructed of two sections 70 and 72 of non-magnetic material, separated by an intervening wall 74 also of non-magnetic material. One of the housing sections, for example 70, is provided with a groove 76 which, together with the intervening wall 74, defines a coin slot. The other housing section 72 is provided with a chamber 78 in which a permanent magnet 80 is freely contained and from one side of which projects a slug rejector finger 82 of non-magnetic material. A resilient loop spring 84 is wrapped about the magnet, bearing at one end against the side of the magnet facing the intervening wall 74 and bearing at its opposite end against said intervening wall, such as to maintain the magnet and the finger 82 in the normally retracted position illustrated in full lines.

As will be understood, upon the attempted insertion of a magnetic coin or other magnetic slug S through the coin slot 76, the permanent magnet 80 will be attracted toward the coin slot against the resistance of the spring 84, whereby the slug rejector finger 82 is projected through an opening 86 in the wall 74 and is extended across the coin slot, as illustrated in broken lines, to intercept the magnetic slug.

In the embodiment of FIG.. 6, a single piece housing 90 of non-magnetic material is provided with a transverse coin slot 92. Disposed substantially perpendicular to the coin slot is a stepped bore. The inner portion 94 of the bore intercepts the coin slot 92 and slidably receives a slug rejector finger 96 which is secured to and projects from one end of a permanent magnet 98 contained freely in the intermediate portion 100 of the bore. The outermost, largest diameter portion 102 of the bore is threaded internally for the removable reception of a plug 104 of non-magnetic material. The plug is provided with a screw driver slot 106 at its outer end and a central tapped bore which adjustably receives a set screw 108 of magnetic material.

Figure 6:
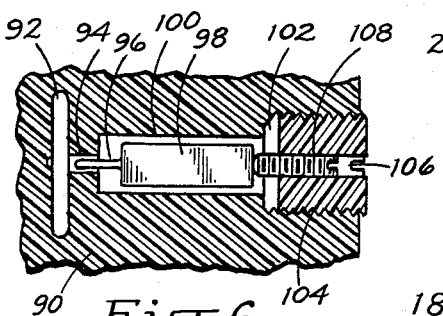
FIG. 6 is a fragmentary view in transverse section of a third embodiment of a coin machine slug rejector embodying the features of this invention.

The inner end of the magnet set screw 108 normally attracts the magnet 98 as to maintain the slug rejector finger 96 in the retracted position relative to the coin slot 92, as shown in full lines in FIG. 6. However, upon the attempted insertion of a magnetic coin or other magnetic slug S through the coin slot, the magnet is attracted toward the coin slot, being released from the set screw 108 which is adjusted longitudinally relative to the coin slot 92 so as to exert less attraction for the magnet 98 than the slug. The slug rejector finger 96 thus is extended across the coin slot to form a positive barrier against passage of the magnetic slug through the coin slot.

It will be apparent that the structural embodiments of FIGS. 5 and 6 may replace the first described embodiment on the adapter shown in FIG. 1. Accordingly, all of the various embodiments illustrated may be attached to existing coin-operated machines with speed and facility and with minimum cost by the simple expediency of an adapter of suitable structural design compatible with the coin inlet slot of the machine.

On the other hand, it will also be apparent that the various forms of slug rejectors illustrated in the drawing may be integrated directly into the coin-operated machine, as by replacement of the conventional escutcheon plate 14 illustrated in FIG. 1.

From the foregoing it will be appreciated that the present invention provides simplified and therefore economical means by which to prevent the entry into coin-operated machines of magnetic coins and other magnetic slugs. The device may be attached to existing coin-operated machines by a simplified adapter which avoids costly modification of the machine itself. Alternatively, the device may be integrated into coin-operated machines so as to function with simplified coin-operated mechanism.

It will be apparent to those skilled in the art that various changes may be made in the size, shape, type, number and arrangement of parts described hereinbefore without departing from the spirit of this invention.

Having now described my invention and the manner in which it may be used, I claim:

1. A rejector of magnetic coins and other magnetic slugs for a coin-operated machine, comprising:

a. a housing having a coin slot therethrough, b. a slug rejector finger in the housing movable between a normal position retracted from said coin slot and an extended position intercepting said coin slot, c. a magnet mounted slidably in a bore in the housing and engaging said rejector finger at one end and arranged to be influenced by a magnetic coin or slug inserted in the coin slot to move the finger to said extended position, and d. magnetic abutment means in the housing disposed adjacent the end of the magnet opposite the finger for normally urging the finger to said normally retracted position.

2. The rejector of claim 1 wherein the abutment means is adjustable relative to the coin slot whereby to exert less magnetic attraction for the magnet than a magnetic coin or slug.

3. The rejector of claim 1 including an adapter arranged for attachment to a coin-operated machine and overlying the coin insert slot of the machine, and means for securing the rejector housing to the adapter with the coin slot of the rejector housing aligned with the coin insert slot of the coin-operated machine.

4. A rejector of magnetic coins and other magnetic slugs for a coin-operated machine having a coin insert slot, the rejector comprising:

a. a housing having a coin slot therethrough, a chamber therein separated from the coin slot by a wall, and a cover plate secured releasably to the housing for closing said chamber, b. a slur rejector finger in the housing movable between a normal position retracted from said coin slot and an extended position intercepting said coin slot, the slug rejector finger comprising a lever disposed within the housing, pivot means on one end of the lever, bearing means on the housing and cover plate releasably receiving said pivot means for mounting the lever pivotally within the housing, a finger projecting from the opposite end of the lever registering with an opening in said separating wall for movement of the projecting finger between said normal and extended positions, c. magnet mounted on the lever and extending between the pivot means and the projecting finger and movable in the housing and arranged to be influenced by a magnetic coin or slug inserted in the coin slot of the rejector housing to move the finger to said extended position to prevent the magnetic coin or slug passing through the coin slot of the rejector housing, and spring means interengaging the housing and lever normally urging the finger to said normal retracted position, d. an adapter arranged for attachment to a coin-operated machine overlying the coin insert slot thereof, and e. means for securing the rejector housing to the adapter with the coin slot of the rejector housing aligned with the coin insert slot of the coin-operated machine.

5. A rejector of magnetic coins and other magnetic slugs for a coin-operated machine having a coin insert slot, the rejector comprising:

a. a housing having a coin slot therethrough, a chamber therein separated from the coin slot by a wall, and a cover plate secured releasably to the housing for closing said chamber, b. a slug rejector finger in the housing movable between a normal position retracted from said coin slot and an extended position intercepting said coin slot, the slug rejector finger comprising a lever disposed within the housing, pivot means on one end of the lever, bearing means on the housing and cover plate releasably receiving said pivot means for mounting the lever pivotally within the housing, a finger projecting from the opposite end of the lever registering with an opening in said separating wall for movement of the projecting finger between said normal and extended positions, c. a magnet mounted on the lever and extending between the pivot means and the projecting finger and movable in the housing and arranged to be influenced by a magnetic coin or slug inserted in the coin slot of the rejector housing to move the finger to said extended position to prevent the magnetic coin or slug passing through the coin slot of the rejector housing, and spring means interengaging the housing and lever normally urging the finger to said normal retracted position, d. and means on the housing for attaching the latter to a coin-operated machine with the coin slot of the rejector housing aligned with the coin insert slot of the coin-operated machine.

6. A rejector of magnetic coins and other magnetic slugs for a coin-operated machine having a coin insert slot through its outer surface, the rejector comprising:

a. a housing having opposed front and back surfaces, a coin slot extending through said front and back surfaces, and a chamber in the housing separated from the coin slot by an internal wall, b. a slug rejector finger member confined within the periphery of the housing and movable between a normal position retracted from said coin slot and an extended position intercepting said coin slot, the slug rejector finger member comprising a lever pivoted at one end within the chamber on a pivot axis disposed parallel to the longitudinal direction of the coin slot and hence parallel to the direction of coin movement through the coin slot, the lever having a finger projecting from the opposite end of the lever and terminating inwardly of the back surface of the housing and registering with a transverse opening in said internal wall communicating the coin slot with the chamber for movement of the projecting finger between said normal and extended positions, c. retraction means in the housing for urging the finger member to said normal retracted position, d. a magnet mounted on the lever within the chamber and arranged to be influenced by a magnetic coin or slug inserted in the coin slot of the rejector housing to move said finger to said extended position to prevent the magnetic coin or slug passing through the coin slot of the rejector housing, and e. means on the housing for attaching the latter to the outer surface of a coin-operated machine with the back surface of the housing facing the coin-operated machine and with the coin slot of the rejector housing aligned with the coin insert slot of the coin-operated machine.

* * * * *

UNITED STATES PATENT AND TRADEMARK OFFICE

CERTIFICATE OF CORRECTION

PATENT NO. : 4,111,292

DATED : September 5, 1978

INVENTOR(S) : Eugene H. Dixon

It is certified that error appears in the above-identified patent and that said Letters Patent are hereby corrected as shown below:

In Claim 4:

Col. 5, Line 10 Change "slur" to --slug--

Col. 5, Line 22 Before "magnet" insert --a--

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*